US007866481B2

(12) United States Patent
Perkins-Stanaford et al.

(10) Patent No.: US 7,866,481 B2
(45) Date of Patent: Jan. 11, 2011

(54) CONTAINER FOR HOLDING AN ARTICLE

(75) Inventors: Marilyn Gale Perkins-Stanaford, Goshen, OH (US); Samuel James Morris, III, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 817 days.

(21) Appl. No.: 11/496,765

(22) Filed: Aug. 1, 2006

(65) Prior Publication Data

US 2007/0209956 A1 Sep. 13, 2007

Related U.S. Application Data

(60) Provisional application No. 60/780,180, filed on Mar. 8, 2006.

(51) Int. Cl.
*B65D 73/00* (2006.01)

(52) U.S. Cl. ..... 206/775; 206/804; 206/1.5

(58) Field of Classification Search ..... 206/1.5, 206/804, 576, 577, 555, 312, 315.3, 751, 206/769, 775–777, 756, 758
See application file for complete search history.

(56) References Cited

U.S. PATENT DOCUMENTS

| | | | | |
|---|---|---|---|---|
| 3,634,947 A | | 1/1972 | Furgal | |
| 3,676,199 A | | 7/1972 | Hewitt et al. | |
| 3,814,236 A | * | 6/1974 | Keilman | 206/338 |
| 3,967,008 A | | 6/1976 | Mizuno et al. | |
| 4,004,685 A | | 1/1977 | Mizuno et al. | |
| 4,014,105 A | | 3/1977 | Furgal et al. | |
| 4,014,432 A | | 3/1977 | Clothier et al. | |
| 4,053,992 A | | 10/1977 | Furgal | |
| 4,098,937 A | * | 7/1978 | Mizuno et al. | 428/68 |
| 4,120,400 A | * | 10/1978 | Kotyuk | 206/528 |
| 4,149,977 A | | 4/1979 | Morganson et al. | |

(Continued)

FOREIGN PATENT DOCUMENTS

BE 1010673 A3 11/1998

(Continued)

OTHER PUBLICATIONS

PCT International Search Report, dated Jul. 17, 2007, 16 pages.

*Primary Examiner*—Ehud Gartenberg
*Assistant Examiner*—Robert Poon
(74) *Attorney, Agent, or Firm*—David V. Upite; Gary J. Foose

(57) ABSTRACT

A container for holding an article includes a deformable sleeve and an inner tray. In one embodiment, the inner tray is adapted to hold the article in the container in an orientation within the deformable sleeve with a portion of the article extending from the inner tray and at a position adjacent an opening in the deformable sleeve through which the article may be removed. In another embodiment, the inner tray includes at least one button adapted to be received in a corresponding aperture in the deformable sleeve. The at least one button and aperture cooperate to resist disengagement between the inner tray and the deformable sleeve by stress placed on the sleeve, and the inner tray is adapted to hold the article in the container in an orientation within the deformable sleeve.

29 Claims, 9 Drawing Sheets

U.S. PATENT DOCUMENTS

| | | | | |
|---|---|---|---|---|
| 4,284,204 | A | 8/1981 | Carey | |
| 4,532,722 | A * | 8/1985 | Sax | 34/60 |
| 4,642,908 | A | 2/1987 | Brenner | |
| 4,736,849 | A * | 4/1988 | Leonard et al. | 206/534 |
| 5,040,311 | A | 8/1991 | Roy | |
| 5,196,132 | A * | 3/1993 | Mains et al. | 510/285 |
| 5,279,409 | A * | 1/1994 | Bowie et al. | 206/5 |
| 5,611,426 | A * | 3/1997 | Warfield | 206/308.1 |
| 5,713,462 | A * | 2/1998 | Hansen | 206/308.1 |
| 5,787,606 | A | 8/1998 | Bokholdt | |
| 5,966,831 | A | 10/1999 | Anderson | |
| 6,149,003 | A * | 11/2000 | Day | 206/449 |
| 6,523,691 | B2 * | 2/2003 | Raj et al. | 206/538 |
| 6,659,271 | B2 * | 12/2003 | Parsons | 206/232 |
| 6,758,340 | B1 * | 7/2004 | Feibelman | 206/775 |
| 6,759,006 | B1 * | 7/2004 | Siklosi et al. | 422/28 |
| 6,908,040 | B2 | 6/2005 | Dong et al. | |
| 6,908,041 | B2 | 6/2005 | Griese et al. | |
| 7,106,202 | B2 * | 9/2006 | Dickinson | 340/572.8 |
| 7,389,875 | B2 * | 6/2008 | Sandberg et al. | 206/531 |
| 2001/0000397 | A1 * | 4/2001 | Rinde | 206/308.1 |
| 2002/0166779 | A1 * | 11/2002 | Etesse et al. | 206/219 |
| 2003/0192130 | A1 | 10/2003 | Lentsch et al. | |
| 2003/0192197 | A1 | 10/2003 | Griese et al. | |
| 2004/0008613 | A1 * | 1/2004 | Beckwith et al. | 369/291 |
| 2005/0192204 | A1 | 9/2005 | Trinh et al. | |
| 2005/0192207 | A1 | 9/2005 | Morgan et al. | |
| 2007/0009634 | A1 | 1/2007 | Rietjens et al. | |
| 2010/0133123 | A1 | 6/2010 | Thibault | |

FOREIGN PATENT DOCUMENTS

| | | |
|---|---|---|
| DE | 1106681 B | 5/1961 |

* cited by examiner

CONTAINER FOR HOLDING AN ARTICLE

RELATED APPLICATION

The present application claims priority under 35 U.S.C. §119 of U.S. Application Ser. No. 60/780,180 filed Mar. 8, 2006.

FIELD OF THE INVENTION

The present invention is directed to containers for holding articles and comprising a deformable sleeve and an inner tray, and to packaged articles comprising a deformable sleeve, an inner tray and an article held within the inner tray.

BACKGROUND OF THE INVENTION

Containers or packages that hold articles such as consumer products are well known in the art. Containers may serve a number of different functions, including, but not limited to, displaying an article in an attractive orientation, providing product information, protecting an article from stress placed upon the container, and/or preventing unauthorized access to an article, for example, prior to purchase. In certain instances, however, a container serving one or more of these purposes makes it difficult for a consumer to gain easy access to the contained article for removal and use of the article. For example, some conventional containers which provide article protection or desired article displays require a user or consumer to gain access to a contained article by removing a portion of the container, sometimes with the user of scissors or other tool, cutting and removing a wrapper enclosing the article, removing an additional enclosure along with the contained article, and/or performing some other cumbersome task. On the other hand, conventional containers which provide easy consumer access to a packaged article sometimes exhibit premature opening during handling owing to stresses placed on the container.

As such, there remains a continuing need in the packaging industry for new containers that sufficiently display and protect an article and/or provide a consumer with easy access to the contained article.

SUMMARY OF THE INVENTION

The present invention provides improvements in containers for holding articles and provides improvements in packaged articles.

In one embodiment, the invention is directed to a container for holding an article and comprises a deformable sleeve and an inner tray. The inner tray is adapted to hold the article in the container in an orientation within the deformable sleeve with a portion of the article extending from the inner tray and at a position adjacent an opening in the deformable sleeve through which the article may be removed.

In another embodiment, the invention is directed to a container for holding an article and comprises a deformable sleeve and an inner tray including at least one button received in a corresponding aperture in the deformable sleeve. The at least one button and the aperture cooperate to resist disengagement between the inner tray and the deformable sleeve by stress placed on the deformable sleeve. The inner tray is adapted to hold the article in the container in an orientation within the deformable sleeve.

In an additional embodiment, the invention is directed to a packaged article comprising a deformable sleeve, an article, and an inner tray including at least one button received in a corresponding aperture in the deformable sleeve. The at least one button and the aperture cooperate to resist disengagement between the inner tray and the deformable sleeve by stress placed on the sleeve. The inner tray holds the article in an angled orientation within the deformable sleeve with a portion of the article extending from the inner tray and at a position adjacent an opening in the deformable sleeve through which the article may be removed.

The containers and packaged articles of the invention are advantageous in providing protection to an article therein, providing easy access to an article when desired, and/or resisting premature opening or article access. Thus, the invention encompasses both a container, without an article packaged therein, and a packaged article. Still other embodiments and advantages of the containers and packaged articles of the present invention will become apparent to those skilled in the art from the following descriptions wherein there are shown and described alternative embodiments of this invention for illustrative purposes. As will be realized, the invention is capable of other different aspects and embodiments all without departing from the scope of the invention. Accordingly, the drawings, objects, and description should be regarded as illustrative and exemplary in nature only and not as restrictive.

BRIEF DESCRIPTION OF THE DRAWINGS

The figures show various embodiments of containers incorporating various aspects of the present invention.

Figure 1:
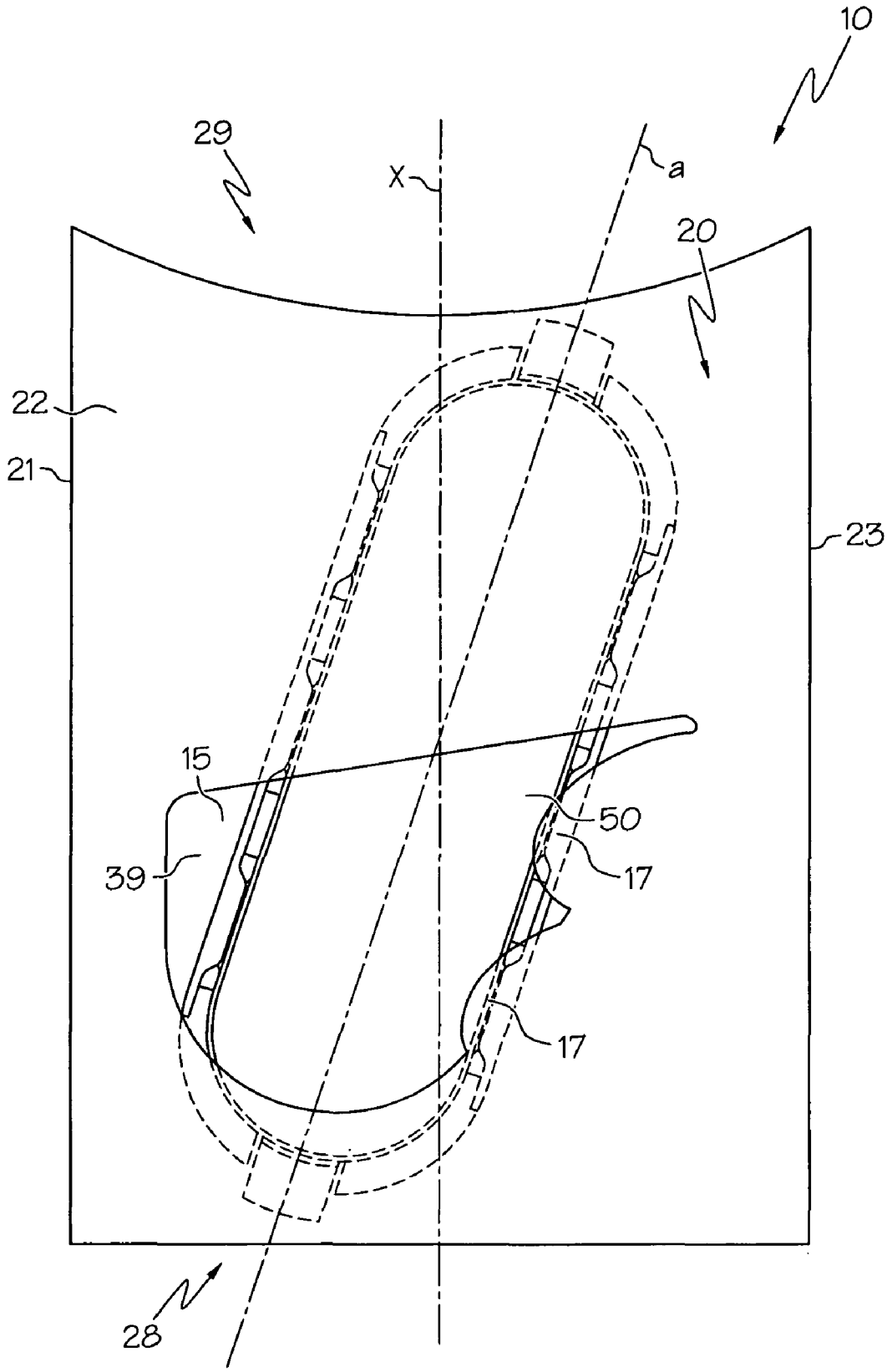
FIG. 1 is a front view of a packaged article in accordance with certain embodiments of the present invention and employing a container in accordance with the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION

Referring to the drawing figures in detail, wherein like numerals indicate the same elements throughout the drawing figures, FIGS. 1-8 illustrate various embodiments of a container and its components. The present invention is directed to containers for holding articles. A container according to the invention comprises a deformable sleeve and an inner tray. A packaged article comprises a deformable sleeve, an inner tray and an article held within the inner tray.

The term "article" is not intended to be limiting in any manner. In one embodiment, the article comprises a consumer product. For example, the container may hold one or more pens, pencils, razors, bars, bottles, or any other item capable of being positioned and held. In one non-limiting embodiment, the article may be a multiple-use, automatic clothing dryer-added fabric conditioning article. Examples of such articles may include those described in U.S. Pat. Nos.: 3,634,947; 3,676,199; 3,967,008; 4,004,685; 4,014,105; 4,014,432; 4,053,992; 4,149,977; 4,642,908; 5,040,311; 5,787,606; 5,966,831; 6,908,041; 6,908,040; and/or U.S. Pat. Pub. Nos.: 2003/0192197; 2003/0195130; 2005/0192204; 2005/0192207, but are not limited thereto.

Generally, with reference to the embodiment shown in FIG. 1, the container 10 of the present invention may be adapted to package an article 50 and comprises a deformable sleeve 20 and an inner tray 30. Within the context of the present specification, "deformable" describes a sleeve that can alter its shape because of stress placed upon it but, at the same time, may substantially recover to its original form when such stress is removed. Additionally, the term "deformable" describes a sleeve that upon deformation, results in little, if any, destructive damage to the sleeve, such as cracking or tearing. Materials which meet these criterion include, but are not limited to, polypropylene, polyethylene, polystyrene, polyethylene-terephthalate, polyvinyl chloride, paperboard, and blends and/or laminations thereof.

Figure 2:
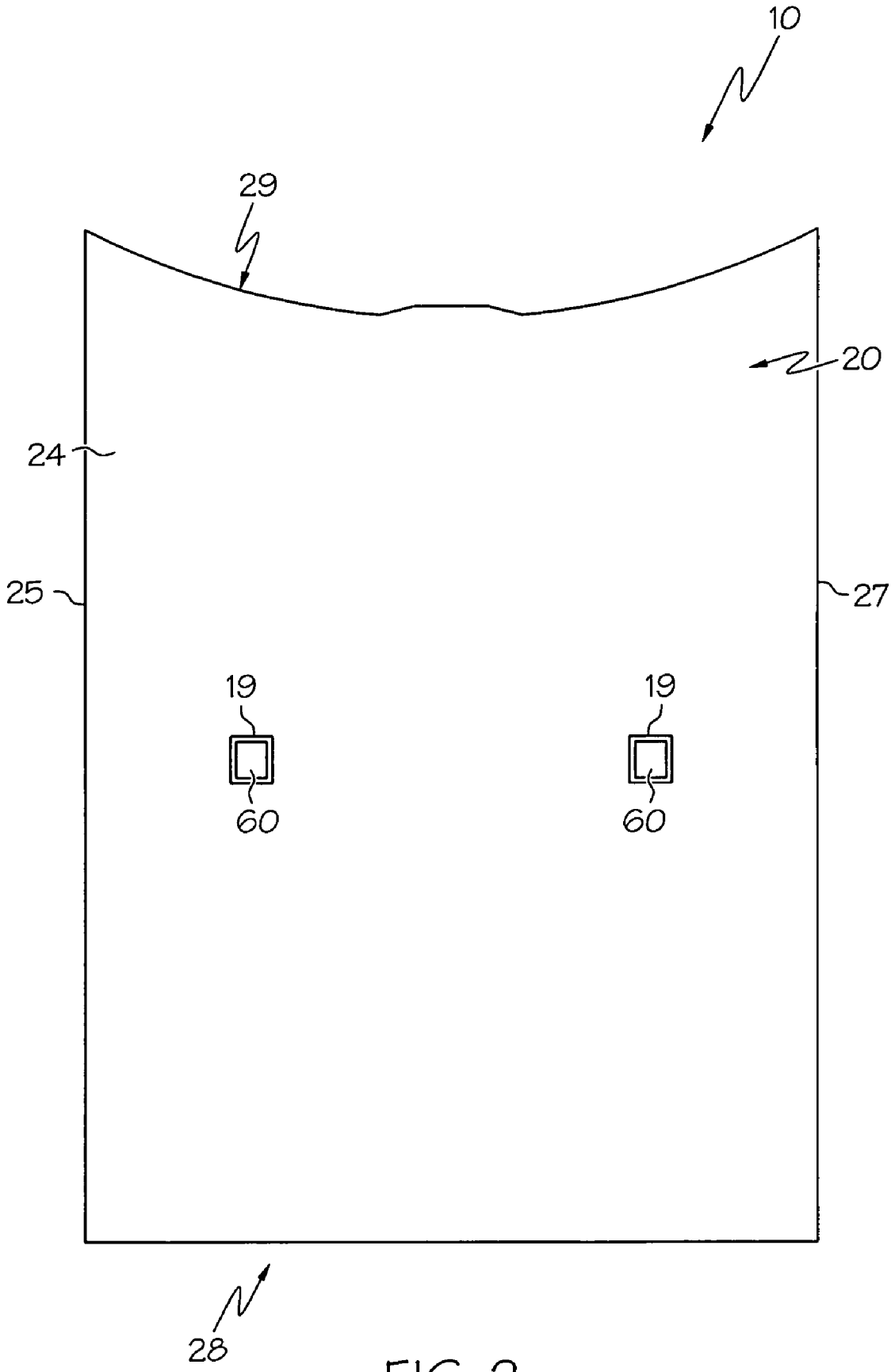
FIG. 2 is a back view of a packaged article in accordance with certain embodiments of the present invention and employing a container in accordance with the present invention.
Figure 3:
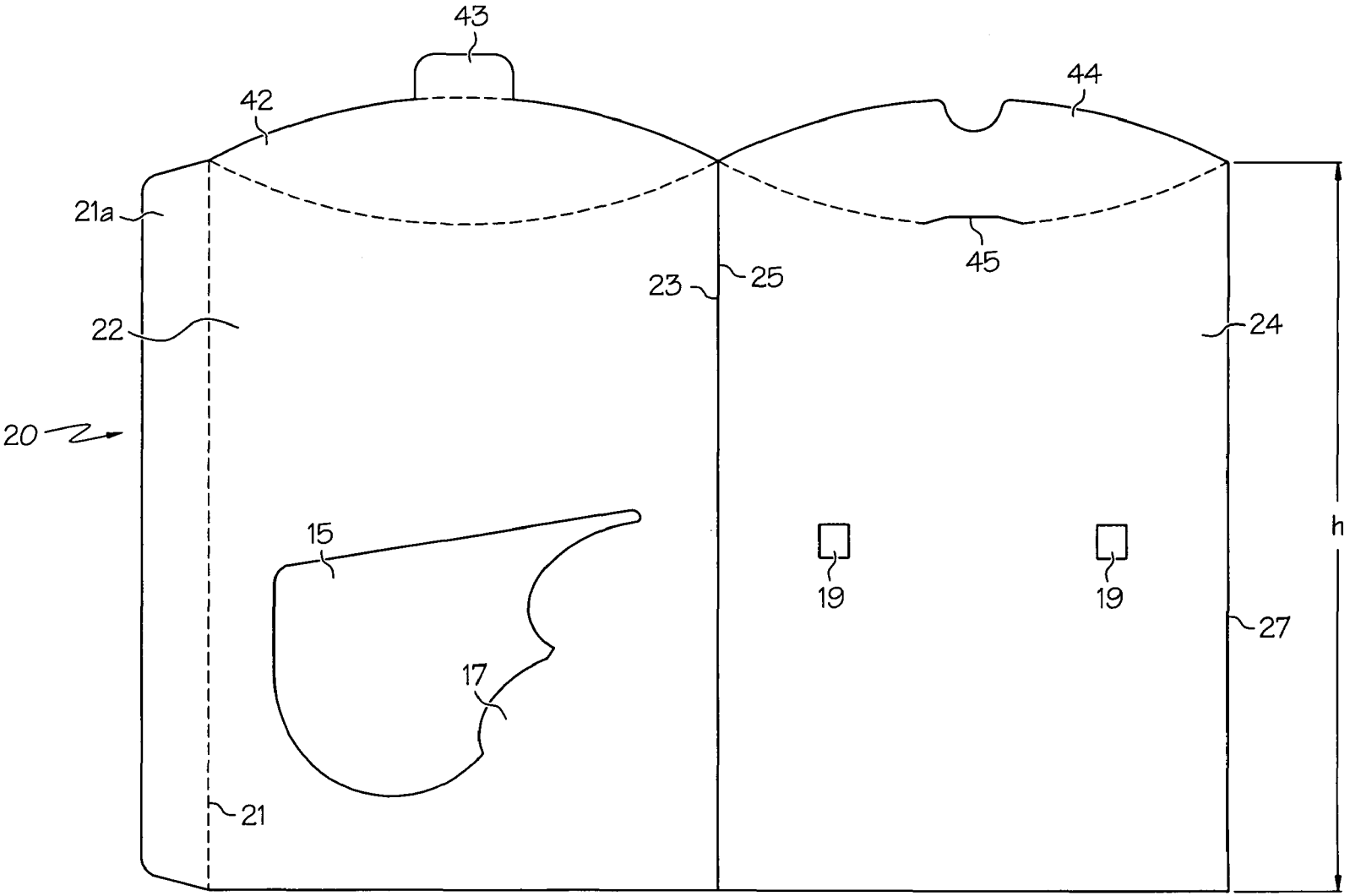
FIG. 3 is a front view of a partially unassembled deformable sleeve in accordance with certain embodiments of the container of the present invention.

In the embodiments illustrated in FIGS. 1-3, the deformable sleeve 20 comprises a first wall 22 and a second wall 24. In one embodiment, the first wall 22 and the second wall 24 of the deformable sleeve 20 intersect and are joined at their respective adjacent side edges. For example, in one embodiment, adhesive or any other attachment means may be provided at the first wall 22 and the second wall 24 intersections to form the deformable sleeve 20. In a specific embodiment, as shown in FIG. 3, a single sheet of deformable material may be folded or shaped to define the intersections between the first wall 22 and the second wall 24.

In a further specific embodiment, as shown in FIGS. 1-3, the first wall 22 includes a left first side wall edge 21 and a right first side wall edge 23. Additionally, the second wall 24 includes a left second side wall edge 25 and a right second side wall edge 27. In assembly of the deformable sleeve, the left first side wall edge 21 joins with the right second side wall edge 27 and the right first side wall edge 23 joins with the left second side wall edge 25. In the embodiment of FIG. 3, the edges 23 and 25 join at a fold line or crease in the deformable material. An extension 21*a* is provided at edge 21 of the first wall 22 and is connected with first wall 22 by a fold line, optionally scored or slit to facilitate folding at edge 21. In assembly of the deformable sleeve, an adhesive is applied to the surface of extension 21 shown in FIG. 3, and/or to an edge surface of the second wall 24 at edge 27, the extension 21*a* is folded toward the first wall 22, and the first wall 22 and the second wall 24 are folded towards one another at edges 23 and 25. The adhesive-coated surface of the extension 21*a* is contacted with a surface of the second wall 24 adjacent edge 27 to securely join the first wall 22 and the second wall 24 at their respective edges 21 and 27. In a specific embodiment, the extension 21*a* is adhered to an inside surface of the second wall 24, rather than an outer surface of the second wall. Any other means of assembling the first wall 22 and the second wall 24 to form the deformable sleeve 20 may also be employed and are within the scope of the present invention.

The deformable sleeve may be open at one or both ends, and may be closable at one or both ends. In one embodiment, the deformable sleeve 20 is closable at one end and is open at the other end. For example, the deformable sleeve 20 of FIG. 8 includes a first end 28 and a second end 29. In one embodiment, the first end 28 is open and, in another, the first end 28 is not closable, i.e., it does not have any closure. In yet another embodiment, the second end 29 has opening 26 which may be closable. In a specific embodiment, opening the closable second end 29 provides unobstructed access through opening 26 to slidably remove the article 50 from the container 10.

Figure 8:
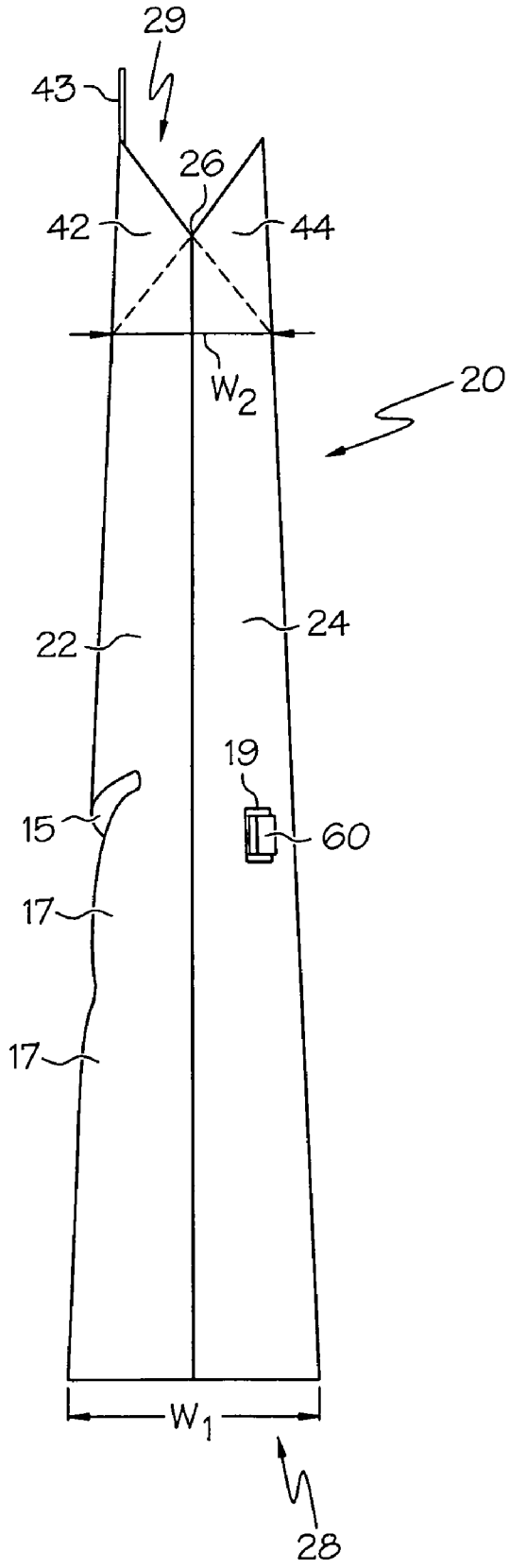
FIG. 8 is a side view of a container in accordance with certain embodiments of the present invention.

In one embodiment, at least one of the first wall 22 and the second wall 24 includes a closure flap or other closure that limits access to the opening 26 in the deformable sleeve 20 through which the article 50 may be removed, as shown in FIGS. 3 and 8. In another embodiment, the first wall 22 includes a first closure flap 42 and the second wall 24 includes a second closure flap 44. In this embodiment, the first closure flap 42 and the second closure flap 44 overlap to limit access to the opening 26 in the deformable sleeve 20 through which the article 50 may be removed. The closure flap(s) may fully or partially close opening 26 as desired. Further, upon overlapping, the first closure flap 42 may include an extension 43 or other means for securing the flaps in place. For example, extension 43 may be inserted into a corresponding opening or slit 45 included in the second closure flap 44. However, any manner of limiting access to the opening 26 in the deformable sleeve 20 through which the article 50 may be removed is within the scope of the invention. For example, such products as Velcro or adhesive could be used to maintain the flaps in a closed position until opening of the container is desired. Similarly, other means to limit access to or close opening 26 may be employed without departing from the scope of the present invention.

The container 10 also comprises an inner tray 30. Materials suitable for the manufacturing of the inner tray 30 may include, but are not limited to, thermoplastic materials such as polypropylene, polyethylene, polystyrene, polyethylene-terephthalate, and blends thereof. In a specific embodiment discussed in further detail below, the inner tray is formed of a transparent material. In further embodiments, the inner tray is formed of a transparent, colorless material or, in some embodiments, a transparent tinted material.

Figure 4:
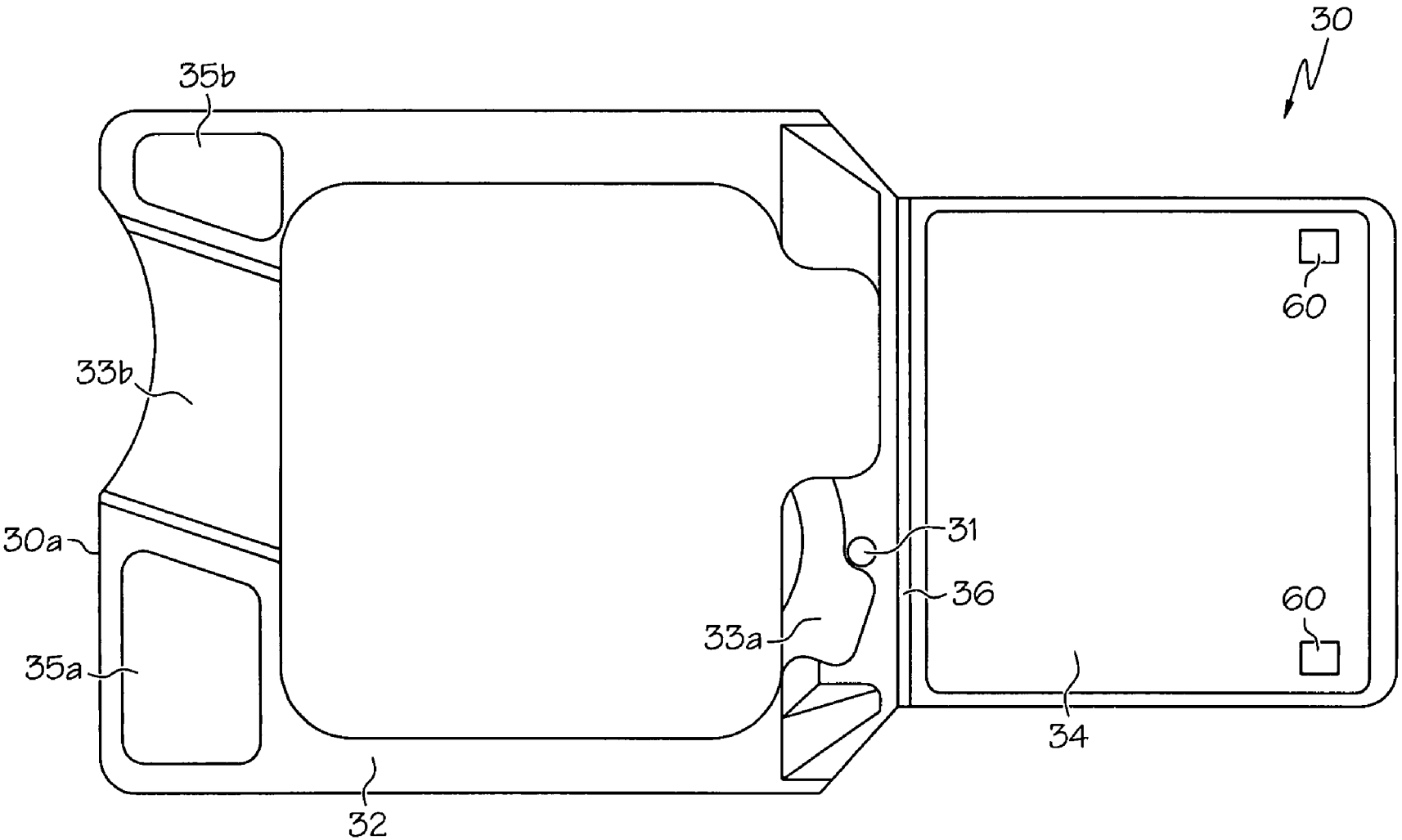
FIG. 4 is a top view of an inner tray in an open position in accordance with certain embodiments of the present invention.
Figure 6:
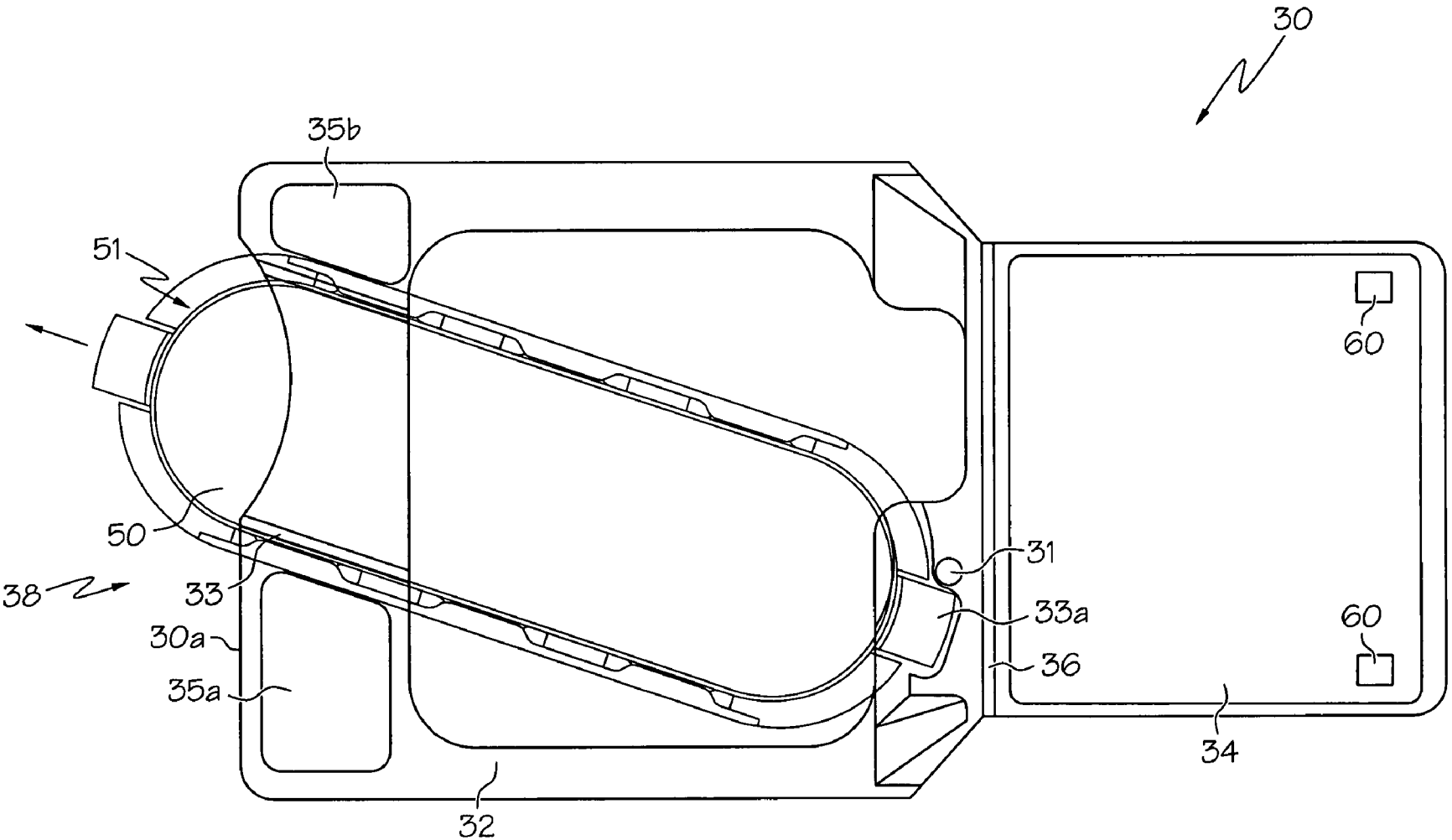
FIG. 6 is a top view of the inner tray of FIG. 4, holding an article in an orientation therein in accordance with certain embodiments of the present invention.

Generally, the inner tray 30 is received within the deformable sleeve 20 and, in one embodiment, provides a user relatively easy access to the article 50 as it holds the article in an orientation within the deformable sleeve 20. Specifically, as illustrated in FIGS. 4 and 6, the inner tray 30 may comprise an edge 30*a* whose profile can be varied and sized to accommodate the article 50 and to facilitate easy access to the article 50. In a specific embodiment, a portion 51 of the article extends from the inner tray and this extending portion 51 is located at a position adjacent an opening, for example, opening 26, in the deformable sleeve 20, through which the article may be removed. Opening the second end 29 and removing the article 50 from the inner tray 30 through opening 26, without requiring removal of the inner tray itself, provides for relatively easy access to the article 50. Thus, inner tray 30 facilitates unobstructed access for removal of the article 50 through opening 26 when the closable second end 29 is opened, and, advantageously, the article 50 may be accessed and removed from the container 10 without requiring removal of the inner tray 30. Furthermore, in a specific embodiment, when the inner tray, holding an article 50 therein, is positioned within the deformable sleeve 20, to provide a packaged article, the extending portion 51 of the article 50 is positioned no more than about 50 mm, more specifically, no more than about 30 mm, from the opening 26 in the sleeve through which the article may be removed. In one non-limiting embodiment, the extending portion 51 of the article 50 is positioned no more than about 28 mm from the opening 26 in the sleeve through which the article may be removed.

In one embodiment, the inner tray 30 may be adapted to hold the article 50 with its longitudinal axis, illustrated as the a-axis in FIG. 1, in an angled orientation relative to an axis of the deformable sleeve 20, illustrated as the x-axis in FIG. 1. Any desired angle orientation may be employed, for example, the inner tray 30 may be adapted to hold the article 50 with its longitudinal axis, illustrated as the a-axis in FIG. 1, in an orientation such that the a-axis is at an angle of from about 10° to about 30° relative to the x-axis of the deformable sleeve 20. In one non-limiting embodiment, the inner tray 30 is adapted to hold the article 50 with its longitudinal axis, illustrated as the a-axis in FIG. 1, at an angle of about 20° relative to an axis of the deformable sleeve 20. Additionally, the angled orientation of this embodiment may allow certain dimensions of the container 10 to be reduced whereby the container 10 may also be more efficiently packaged for shipment. As such, the angled orientation may reduce the cost of manufacturing, transporting, and/or delivering the containers 10.

Figure 7:
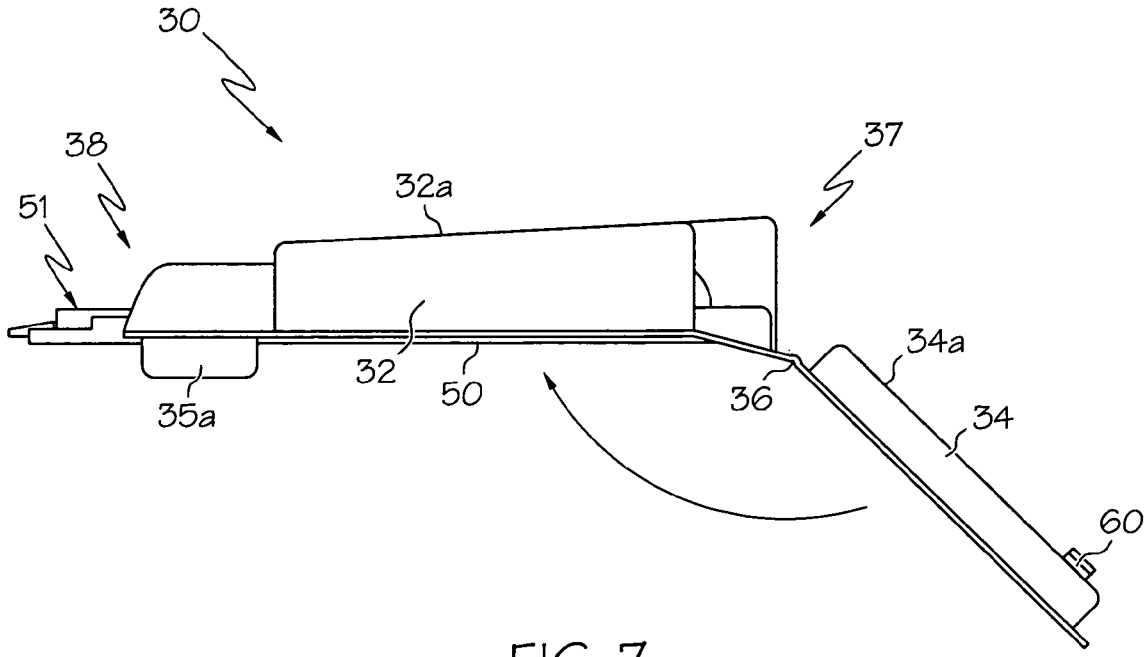
FIG. 7 is a side view of the inner tray of FIG. 4 holding an article in an orientation therein and illustrating a supporting member pivoting toward a closed position in accordance with certain embodiments of the present invention.
Figure 7A:
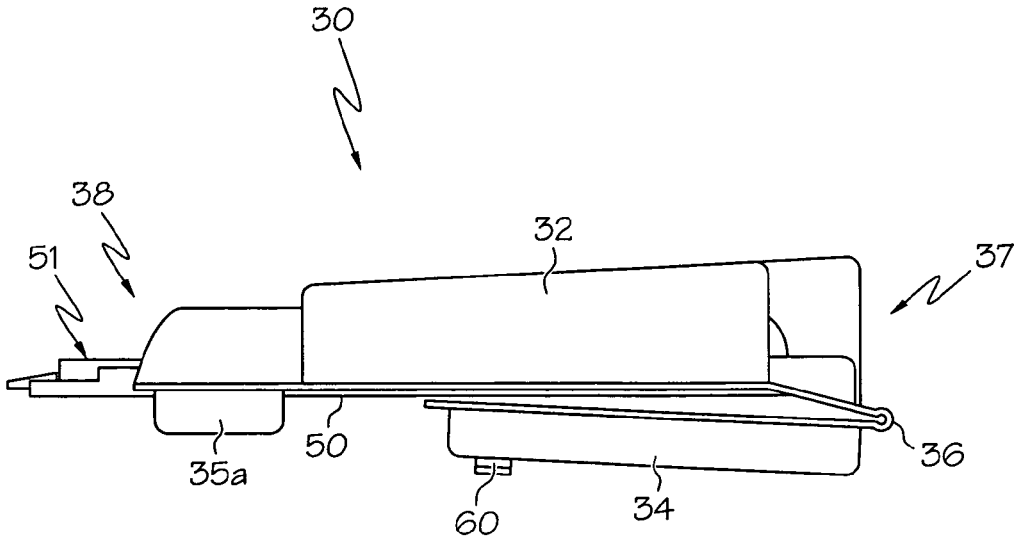
FIG. 7A is a side view of the inner tray of FIG. 4 holding an article in an orientation therein and illustrating a supporting member in a closed position in accordance with certain embodiments of the present invention.

FIGS. 4-7B show a specific, non-limiting configuration of an inner tray 30 according to the invention. In this embodiment, the inner tray 30 comprises a first supporting member 32 and a second supporting member 34 pivotally connected to the first supporting member 32 by a hinge 36. In this embodiment, as illustrated in FIG. 7, the second supporting member 34 may be pivoted about the hinge 36 towards the first supporting member 32 and, as such, closes the inner tray, as illustrated in FIG. 7A, to assist in holding the article 50 in the orientation within the inner tray. Additionally, without departing from the scope of the present invention, the hinge 36 may comprise, but is not limited to, any means that allows the supporting members 34, 36 to pivot toward one another with the article 50 positioned within the inner tray in the desired orientation.

As further shown in FIGS. 4-7B, the illustrated embodiment of the inner tray 30 comprises a base end 37 and an access end 38. When the inner tray is received within the deformable sleeve 20, the base end 37 is positioned adjacent the deformable sleeve first end 28 and the access end 38 is positioned toward the second end 29 of the deformable sleeve. In one embodiment, the access end 38 is spaced from the second end to facilitate access to the article 50. In a more specific embodiment, the access end 38 may be positioned at least about 40 mm, more specifically at least about 50 mm, from the second end 29. In one non-limiting embodiment, however, the access end 38 is positioned at about 55 mm from the second end 29. In the embodiment illustrated in FIG. 8, the first end 28 of the deformable sleeve 20, having the inner tray received therein, is expanded to have a width $w_1$ greater than a width $w_2$ of the second end 29. This feature may assist in maintaining the container in a stable position on end 28. In one embodiment, the expanded width w, may be from about 35 mm to about 60 mm and the expanded width $w_2$ may be from about 25 mm to about 40 mm. In one non-limiting embodiment, the expanded width $w_1$ is about 46 mm and the expanded width $w_2$ is about 35 mm.

Figure 5:
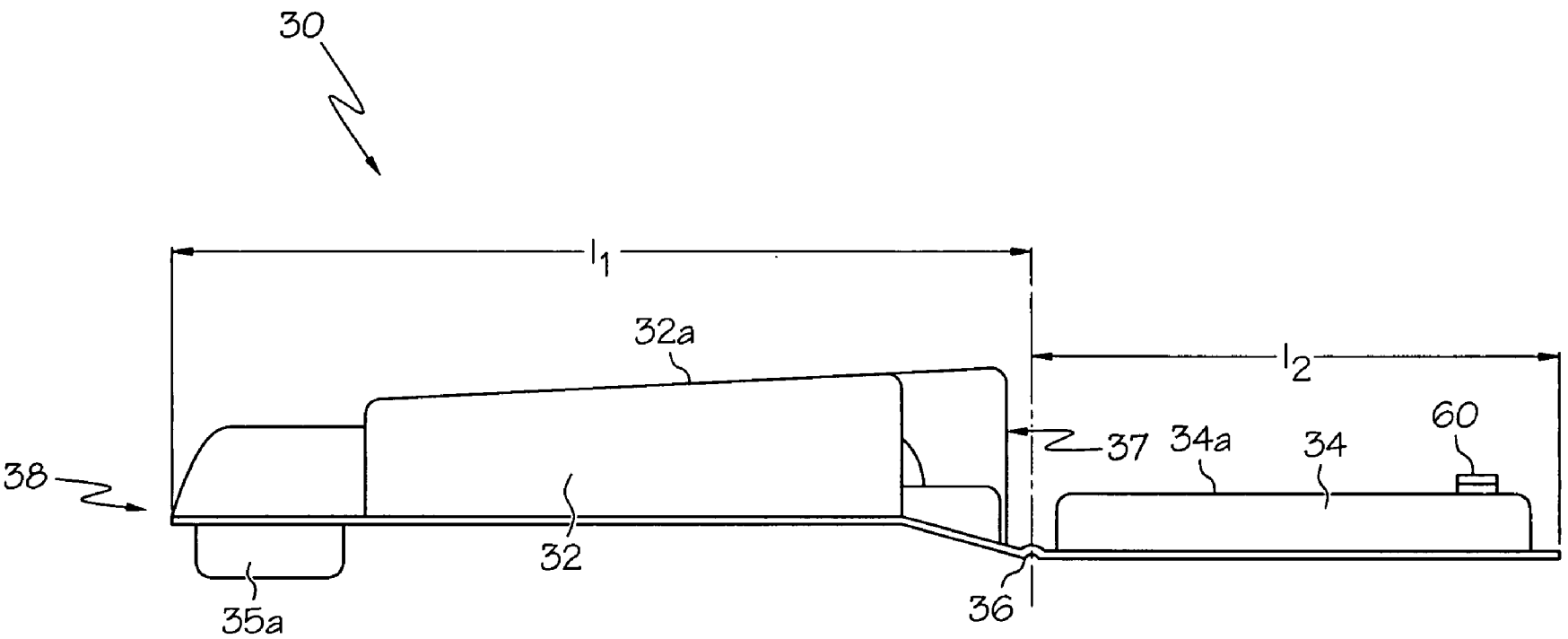
FIG. 5 is a side view of the inner tray of FIG. 4 in an open position.

The first supporting member 32 has a first length $1_1$, as shown in FIG. 5, extending from the base end 37 toward the access end 38, and the second supporting member 34 has a second length $1_2$ extending from the base end 37 toward the access end 38. The supporting members of the tray may be dimensioned as desired. In one non-limiting embodiment, the first length $1_1$ may be from about 100 mm to about 170 mm and the second length $1_2$ may be from about 60 mm to about 170 mm. In a more specific non-limiting embodiment, the first length $1_1$ is about 140 mm and the second length $1_2$ is about 90 mm. Additionally, in the illustrated embodiment, the first length $1_1$ is greater than the second length $1_2$, to facilitate access to the article held within the inner tray. However, in alternate embodiments, the supporting members may be substantially equal in length or the second supporting member 34 may be longer than the first supporting member 32. As will be apparent, when a portion of the article extends from the inner tray 30, the greater of $1_1$ and $1_2$ is shorter than the height $h_1$ of the deformable sleeve.

Referring now to FIGS. 4 and 6, the inner tray 30 may comprise a denesting area 31. The denesting area 31 may be sized and configured to provide for relatively easy access to the article 50 and may reduce the cost of both shipping the inner tray 31 and assembling the container 10. In one embodiment, the denesting area 31 may be adapted to partially receive a corresponding denesting area of an additional inner tray and still provide sufficient space for relatively easy separation of the trays. In a specific embodiment, the inner tray 30 may also comprise indentations 33*a* and 33*b* and tabs 35*a* and 35*b*. The indentations 33*a* and 33*b* are adapted to receive, position and maintain the article 50 in a desired orientation. The tabs 35*a* and 35*b* are also adapted to cooperate with and position the article 50 in the desired orientation. The tabs 35*a* and 35*b* may also expand and shape the deformable sleeve 20 when the inner tray 30 is received in the deformable sleeve. In yet other embodiments, outer surfaces 32*a* and 34*a* of the first supporting member 32 and the second supporting member 34, respectively, of the inner tray 30 may be configured to further expand and shape the deformable sleeve 20 when the inner tray is received therein. In one embodiment, the indentations, tabs and other configurations of the inner tray allow the article held therein to be slidingly removed from the inner tray when the inner tray is in a closed position. With reference to FIG. 6, the article may be slidingly removed from the inner tray by sliding the article in the direction shown by the arrow. As will be apparent, once the article is placed in the inner tray and the inner tray is received within the deformable sleeve, the deformable sleeve may assist in maintaining the inner tray in its closed position to hold the article.

As illustrated in FIGS. 4 and 6, the inner tray 30 may also include a locking mechanism to provide resistance to unintended separation of the inner tray and the deformable sleeve, for example by stresses placed on the container. For example, the inner tray 30 includes at least one button 60 on an outer surface of one of the supporting members. The button 60 is adapted to be received in a corresponding aperture 19 in the deformable sleeve 20. Both the aperture 19 and the button 60 may be sized and located in any position suitable to resist stresses causing unintended separation. For example, in one embodiment, both the aperture 19 and the button 60 may be shaped in a generally square or rectangular configuration, although other aperture and button shapes may be employed as well. In one non-limiting embodiment, the aperture 19 may be from about 6 mm to about 22 mm in length and from about 6 mm to about 22 mm in height and the button 60 may be from about 4 mm to about 20 mm in length and from about 4 mm to about 20 mm in height. In yet another specific embodiment, the aperture 19 is a 8 mm×8 mm square and the button 60 is a 6 mm×6 mm square. In yet other embodiments, the area of the aperture 19 is at least about 25 $mm^2$, the area of the button is at least about 9 $mm^2$, and the area of the second wall 24 of the deformable sleeve 20, including the second closure flap 44, is at least about 20,000 $mm^2$. In a specific embodiment, the area of the aperture 19 is about 64 $mm^2$, the area of the button is about 36 $mm^2$, and the area of the second wall 24 of the deformable sleeve 20, including the second closure flap 44, is about 26,500 $mm^2$. In one embodiment, the area of the aperture 19 is less than about 0.5% of the total area of the second wall 24 of the deformable sleeve 20, including the second closure flap 44. In a specific embodiment, the area of the aperture 19 is less than about 0.3% of the total area of the second wall 24 of the deformable sleeve 20, including the second closure flap 44.

In a specific embodiment of the deformable sleeve 20, having a width of about 130 mm and a height of about 200 mm, the aperture 19 is positioned so that when the tray 30 is received in the deformable sleeve 20 and the center of the button 60 is received in the aperture 19, the button 60 is located from about 10 mm to about 70 mm, more specifically from about 15 mm to about 50 mm, or about 35 mm, from an intersection of the first side wall 22 and the second side wall 24 and from about 70 mm to about 115 mm, more specifically about 80 mm, from the first open end 28. In a more specific non-limiting embodiment, the center of the button is located about 35 mm from am intersection of the first side wall 22 and the second side wall 24 and about 80 mm from the first open end 28. In one embodiment, the center of button 60 is located from about 1/20 to about 1/2, more specifically from about 1/10 to about 2/5, from an intersection of the first side wall 22 and the second side wall 24 relative to the width of the deformable sleeve 20 and from about 3/4 to about 1/4, more specifically from about 2/3 to about 1/3, from the first open end 28 relative to the height of the deformable sleeve 20.

In yet another embodiment, the inner tray 30 includes two or more buttons 60, adapted to be received in two or more corresponding apertures 19 of the deformable sleeve 20. Additionally, in a more specific embodiment, each aperture 19 and corresponding button 60 are positioned so that when the tray is received within the deformable sleeve and the buttons 60 are received within the apertures 19, each button center is located as described above, and more specifically, about 35 mm from an intersection of the first side wall 22 and the second side wall 24 and about 80 mm from the first open end 28. When two or more aperture/button combinations are employed, they may be horizontally aligned, as shown in FIG. 2, or they may be staggered as desired. In an additional specific embodiment, the buttons 60 are located on the outer surface 34*a* of the second supporting member 34 of the inner tray 20. In one embodiment, as illustrated in FIGS. 5, 7 and 7A, the buttons 60 protrude at least about 1 mm from the outer surface 34*a*. Additionally, in a more specific embodiment, the buttons 60 protrude about 3 mm from the outer surface 34*a*. In yet another specific embodiment, the apertures 19 in the deformable sleeve 20 are located on the second wall 24 of the deformable sleeve 20.

The button 60 and the aperture 19 are adapted to engage and cooperate to resist disengagement between the inner tray 30 and the deformable sleeve 20 by stress placed on the deformable sleeve 20. In one embodiment, the sides 61 of button 60 may be substantially perpendicular to an outer surface 34*a* of the second supporting member 34. In this embodiment, the sides 61 may cooperate with the deformable sleeve 20 to resist disengagement between the inner tray 30 and the deformable sleeve 20 by stress placed on the deformable sleeve 20. In particular, in one embodiment, the button 60 and the aperture 19 cooperate to resist disengagement by stresses placed upon either the open end 28, the first side wall 22 and/or the second side wall 24 of the deformable sleeve 20. For example, stress may be placed upon the deformable sleeve 20 during shipping or storage, as a result of dropping the container 10 upon its open end 28, and/or from unintentional squeezing of the container's side walls.

Figure 7B:
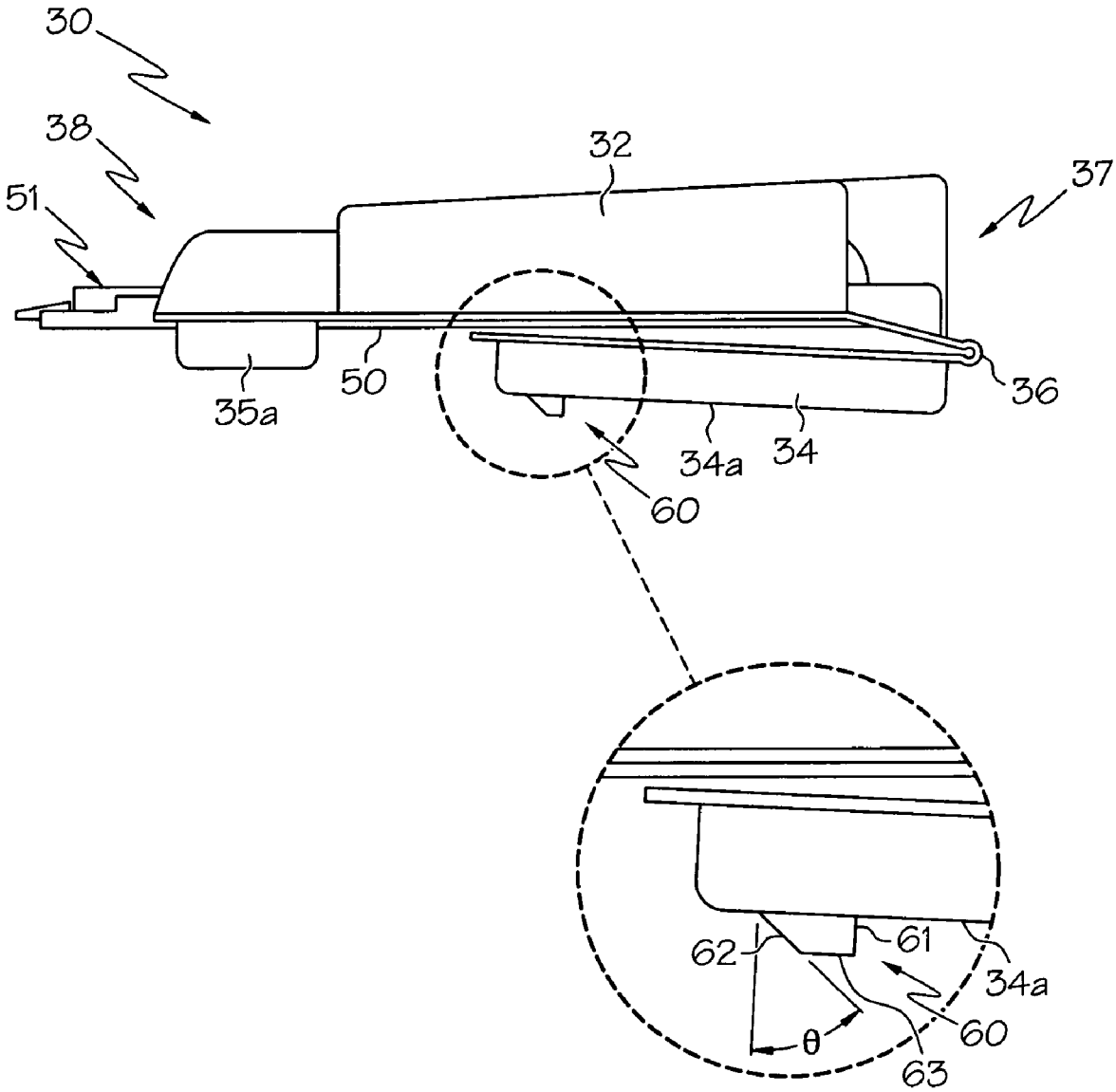
FIG. 7B is a side view of the inner tray of FIG. 4 holding an article in an orientation therein and illustrating a supporting member in a closed position and a button including a ramped portion in accordance with certain embodiments of the present invention.

In one embodiment, as illustrated in FIG. 7B, the button 60 may include a ramped portion 62. The ramped portion 62 may be adapted to form a connection between the outer surface 34*a* of the second supporting member 34 and a top portion 63 of the button. In one embodiment, the ramped portion 62 may form an angle of from at least about 5° to at least about 70° relative to an axis perpendicular to an outer surface 34*a* of the second supporting member 34 (i.e., θ in FIG. 7B). In yet another specific embodiment, the ramped portion 62 forms an angle of about 45° relative to an axis perpendicular to an outer surface 34*a* of the second supporting member 34. Further, in one embodiment, the ramped portion 62 may help facilitate engagement between the deformable sleeve 20 and the inner tray 30 and, in particular, allow for quicker and easier assembly of the container 10. For example, while the inner tray 30 is inserted to a desired position within the deformable sleeve 20, the angled structure of the ramped portion 62 may allow a button 60 to more readily traverse the distance $h_2$ between a first end 28 and the aperture 19. In one specific embodiment, the ramped portion 62 of the button 60 may be located towards the access end 38 of the inner tray 30 when the inner tray 30 is in a closed position. In yet another specific embodiment, the ramped portion 62 of the button 60 may be located towards the base end 37 of the inner tray 30 when the inner tray 30 is in a closed position.

As illustrated in FIGS. 1 and 3, the deformable sleeve 20 may be provided with a window 15. In one embodiment, the window 15 is located on the first wall 22 of the deformable sleeve 20. In another embodiment, the window 15 is positioned adjacent the inner tray 30. However, generally, the window 15 may be located on any portion of the deformable sleeve 20 without departing from the scope of the present invention. The specific embodiment of the window 15 illustrated in FIGS. 1 and 3 includes a scallop shape 17. However, it is envisioned that in other embodiments, the window 15 may include other various shapes and designs as desired.

As discussed above, the inner tray 30 may be formed of a transparent material. This embodiment is advantageous to present at least a portion of the article 50 held in the inner tray 30 for viewing through the window 15. In this embodiment, the article 50 may be presented at the window to show a particular feature of the article to a consumer without any need to open the deformable sleeve 20 and/or to remove the article 50 from the container. As such, in this embodiment, the inner tray 30 not only holds the article 50 in the container 10 in an orientation within the deformable sleeve 20, but also presents the article 50 for viewing. In yet another embodiment, the wall 39 of the inner tray 30 at the window 15 is transparent and the view through the window 15 is substantially free of the remainder of the inner tray 30. In this embodiment, the article 50 may be viewed through the window 15 without the inner tray 30 providing a substantial interference to the view.

As noted above and shown in FIG. 8, the width $w_1$, at the open end 28 of the container is greater than the width $w_2$ of the container at its opposite end 29. Thus, the container 10 may be conveniently positioned, i.e., displayed for sale, by placing the open end 28 upon a surface. In another embodiment, the container 10 may be displayed by placing the open end 28 in a display apparatus. In yet another embodiment, a plurality of containers 10 may be displayed by placing their respective open ends 28 upon a surface and/or a display apparatus. For example, the plurality of containers 10 may be placed in a display tray, for example of cardboard or the like, (e.g. 30" or 36") for display of the containers 10 on an aisle shelf, in a "power wing" or "side-kick" display device for display of the containers 10 above a surface, for example from a wire, or in a floor stand for display of the containers 10 on the ground. The overall configuration of the container of the invention may facilitate its display in any of these devices.

To assemble an exemplary embodiment of a container and article of the present invention, an article 50 may be received and positioned in the appropriate indentations 33 and/or tabs 35 of the first supporting member 32, and the second supporting member is pivoted toward the first supporting member 32 to close the inner tray and hold the article 50 within the inner tray. The inner tray 30 is then slidably inserted into the deformable sleeve 20 through either the first end 28 or the second end 29. In a specific embodiment, the inner tray is inserted to a position at which one or more buttons 60 on an outer surface of the tray are received in corresponding apertures 19 on the deformable sleeve. As such, the article is held within the container 10 in the desired orientation within the deformable sleeve 20. Further, the article may be easily removed from the inner tray and then from the container through opening 26. Specifically, once any closure over opening 26 is opened, a user may take hold of the portion 51 of the article extending from the inner tray and slidingly remove the article from the inner tray and the deformable sleeve.

As will be apparent, the container in accordance with the present invention may display articles of varying sizes and shapes in a variety of different orientations and can include deformable sleeves and inner trays of various sizes and shapes. Accordingly, while some of the alternative embodiments of the container have been discussed specifically, other embodiments will be apparent or relatively easily developed by those of ordinary skill in the art. Accordingly, this invention is intended to embrace all alternatives, modifications and variations that have been discussed herein, and others that fall within the spirit and broad scope of the claims.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product comprising an article and a container for holding the article, comprising:

a) the article comprising a multiple-use, automatic clothing dryer-added fabric conditioning article;

b) a deformable sleeve; and c) an inner tray adapted to hold the article in the container in an orientation within the deformable sleeve with a portion of the article extending from the inner tray and at a position adjacent an opening in the deformable sleeve through which the article may be removed.

2. The product of claim 1, wherein the inner tray is adapted to hold the article in an angled orientation relative to an axis of the deformable sleeve.

3. The product of claim 1, wherein the inner tray comprises a first supporting member, a second supporting member, and a hinge pivotally connecting the first supporting member and the second supporting member.

4. The product of claim 3, wherein the deformable sleeve comprises a first end and a closable second end.

5. The product of claim 4, wherein the first end is not closable.

6. The product of claim 4, wherein the inner tray is adapted to hold the article, and wherein the second end in an open configuration provides unobstructed access to remove the article.

7. The product of claim 6, wherein the second end in an open configuration provides unobstructed access to slidably remove the article.

8. The product of claim 6, wherein the inner tray comprises a base end and an access end, wherein the base end is adjacent the sleeve first end and has a width greater than a width of the access end.

9. The product of claim 8, wherein the access end is positioned at least about 40 mm from the closable second end.

10. The product of claim 8, wherein the first supporting member has a first length extending from the base end toward the access end, the second supporting member has a second length extending from the base end toward the access end, and the first length is greater than the second length.

11. The product of claim 1, wherein the deformable sleeve is provided with a window positioned adjacent the inner tray.

12. The product of claim 11, wherein the inner tray is formed of a transparent material and is adapted to present an article held in the tray for viewing through the window.

13. The product of claim 12, wherein the inner tray presents a transparent wall at the window and the view through the window is substantially free of the remainder of the inner tray.

14. The product of claim 1, wherein the inner tray is slidably inserted into the deformable sleeve.

15. The product of claim 1, wherein the inner tray comprises a first supporting member and a second supporting member, and wherein at least one of the supporting members includes an indentation which is adapted to receive and position an article in the orientation.

16. The product of claim 1, wherein the inner tray comprises a first supporting member and a second supporting member, and wherein at least one of the supporting members includes a tab which is adapted to cooperate with and position an article in the orientation and/or provide shape to the deformable sleeve.

17. The product of claim 1, wherein the inner tray comprises a first supporting member, and wherein the first supporting member and the second supporting member provide shape to the deformable sleeve.

18. The product of claim 1, wherein the deformable sleeve comprises a first wall and a second wall, and wherein at least one of the first wall and second wall includes a closure flap that limits access to the opening in the sleeve through which the article may be removed.

19. The product of claim 18, wherein the first wall includes a first closure flap and the second wall includes a second closure flap, and wherein the first closure flap and the second closure flap overlap to limit access to the opening in the sleeve through which the article may be removed.

20. A product comprising an article and a container for holding the article, comprising:

a) the article comprising a multiple-use, automatic clothing dryer-added fabric conditioning article;

b) a deformable sleeve; and c) an inner tray including at least one button received in a corresponding aperture in the deformable sleeve, wherein the at least one button and the aperture cooperate to resist disengagement between the inner tray and the deformable sleeve by stress placed on the deformable sleeve, and wherein the inner tray is adapted to hold the article in the container in an orientation within the deformable sleeve.

21. The product of claim 20, wherein the inner tray includes two buttons received in corresponding apertures in the deformable sleeve.

22. The product of claim 21, wherein the deformable sleeve comprises a first wall and a second wall which intersect at their respective side edges, wherein the deformable sleeve further comprises a first open end and a second end, and wherein the two buttons are positioned at least about 35 mm from the side edge intersections and at least about 80 mm from the first open end.

23. The product of claim 21, wherein the inner tray further comprises a first supporting member, a second supporting member, and a hinge that pivotally connects the first and the second members, wherein the buttons are located on the second supporting member.

24. The product of claim 20, wherein the deformable sleeve comprises a first wall and a second wall which intersect at their respective side edges, wherein the deformable sleeve further comprises a first open end and a second end, and wherein the button is positioned at least about 15 mm from the side edge intersections and at least about 60 mm from the first open end.

25. The product of claim 20, wherein the button is a 6 mm ×6 mm square.

26. The product of claim 20, wherein the button comprises a ramped-portion.

27. A product comprising an article and a package packaging the article, comprising:

a) the article comprising a multiple-use, automatic clothing dryer-added fabric conditioning article;

b) the package comprising:

i) a deformable sleeve;

ii) an inner tray including at least one button received in a corresponding aperture in the deformable sleeve, wherein the at least one button and the aperture cooperate to resist disengagement between the inner tray and the deformable sleeve by stress placed on the deformable sleeve, and wherein the inner tray holds the article in an angled orientation within the deformable sleeve with a portion of the article extending from the inner tray and at a position adjacent an opening in the deformable sleeve through which the article may be removed.

28. The product of claim 27, wherein the deformable sleeve is provided with a window positioned adjacent the inner tray, and wherein the inner tray is formed of a transparent material to present the article held in the tray for viewing through the window.

29. The product of claim 28, wherein the deformable sleeve comprises a first wall and a second wall, and wherein the window is located on the first wall and the aperture is located on the second wall.

* * * * *